United States Patent [19]

Schwartz et al.

[11] Patent Number: 4,747,294

[45] Date of Patent: May 31, 1988

[54] FASTENER PRESENTATION DEVICE

[75] Inventors: Sidney D. Schwartz, Hamden; Thomas P. Shamaly, Shelton; Donald Viscio; Raymond H. Varian, both of Danbury, all of Conn.

[73] Assignee: USM Corporation, Farmington, Conn.

[21] Appl. No.: 27,752

[22] Filed: Mar. 19, 1987

[51] Int. Cl.[4] ..... B21J 15/10

[52] U.S. Cl. ..... 72/391; 72/453.19; 227/51; 227/112; 29/809; 29/243.54; 414/744 B; 901/40

[58] Field of Search ..... 72/391, 453.17, 453.19, 72/114, 420; 227/53, 112, 118, 51; 29/809, 816, 818, 243.53, 243.54; 294/64.1; 414/225, 737, 752, 744 B; 901/40; 271/98

[56] References Cited

U.S. PATENT DOCUMENTS

| | | | |
|---|---|---|---|
| 2,569,891 | 10/1951 | Holter | 227/112 |
| 3,406,837 | 10/1968 | Kirsch et al. | 414/744 |
| 3,415,102 | 12/1968 | Elliott | 72/391 |
| 3,580,457 | 5/1971 | Henshaw | 72/391 |
| 3,658,230 | 4/1972 | Enouk | 227/112 |
| 3,946,926 | 3/1976 | Willis | 227/112 |
| 4,005,519 | 2/1977 | Di Maio et al. | 72/391 |
| 4,044,462 | 8/1977 | Anselmo | 29/243.53 |
| 4,065,001 | 12/1977 | Ohnaka | 414/737 |
| 4,205,547 | 6/1980 | Yamasaka | 72/391 |
| 4,364,707 | 12/1982 | Ott | 901/40 |
| 4,586,362 | 5/1986 | Dean et al. | 72/391 |
| 4,592,136 | 6/1986 | Hirsch | 29/809 |
| 4,645,112 | 2/1987 | Davern et al. | 227/112 |

OTHER PUBLICATIONS

A. E. DiMaio, "Portable and Automated Blind Riveting Systems", pp. 8–21.

*Primary Examiner*—David Jones
*Attorney, Agent, or Firm*—Arthur B. Moore

[57] ABSTRACT

A device for automatically presenting mandrel rivets to the nosepiece of a rivet installation tool, which receives rivets from a supply in a slidably mounted transfer arm while the arm is in a retracted position, and axially and radially moves the arm relative to the tool axis to a position of alignment with receiving jaws within the tool. The rivet is then propelled into the tool's nosepiece from the transfer arm by an air blast. The presentation device may be separately mounted within a rivet installation machine, or may be mounted to the tool body in a hand-held configuration. A first version provides successive, separately actuated axial and angular movements of the transfer arm, while a second version provides simultaneous axial and angular movement of the arm. The rivet is held within the transfer arm by a vacuum, which vacuum may be rapidly changed to a positive pressure on command to propel the rivet from the arm into the tool.

21 Claims, 3 Drawing Sheets

FIG. 1
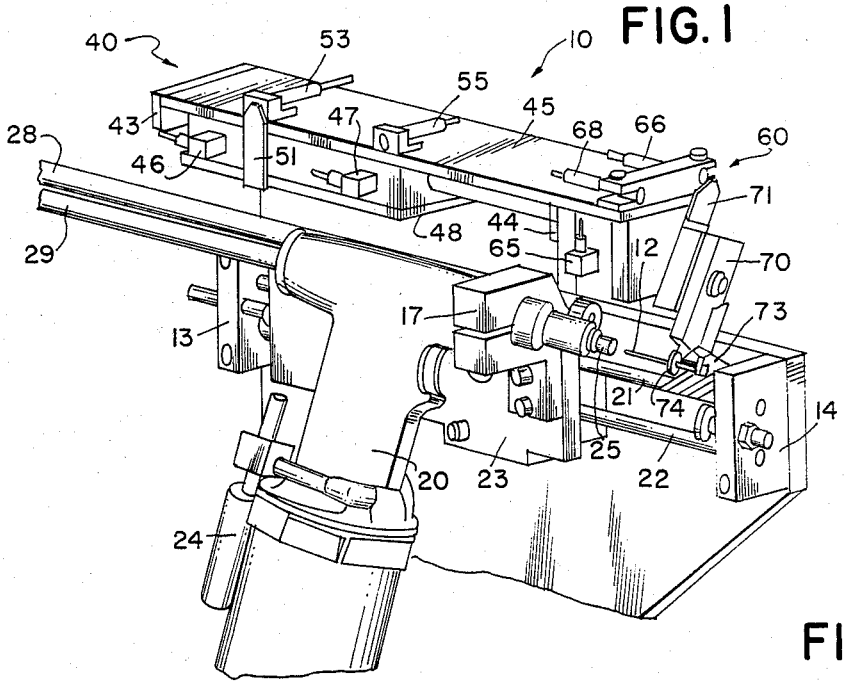
FIG. 3
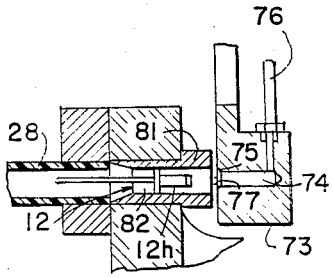
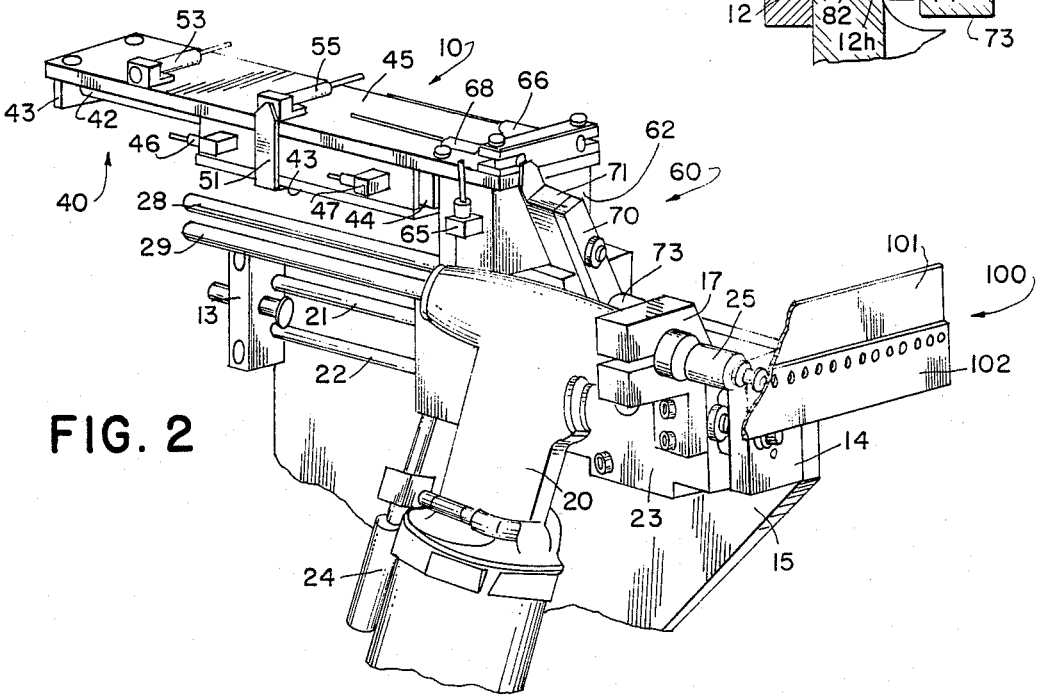
FIG. 2

FASTENER PRESENTATION DEVICE

BACKGROUND OF THE INVENTION

The present invention relates to apparatus for installation of blind rivets and other fasteners, and more particularly to apparatus for presenting fasteners in a desired orientation and position for insertion into fastener application tools or machines.

In the design of efficient fastener application systems, it is desirable to automatically present the fastener to the fastener application tool or machine in a predetermined disposition. For example, blind fasteners of a rivet-mandrel type are adapted to be secured to workpieces and comprise a hollow rivet with a flange at one end and a headed mandrel having a stem extending through the barrel of the rivet. Upon inserting of the barrel of the rivet into a workpiece opening, the mandrel stem is grasped by a setting tool and pulled so that the mandrel head upsets the rivet body against the unexposed surface of the workpiece. Examples of such tools are shown in U.S. Pat. Nos. 3,981,377 and 4,205,547.

There are a variety of different types of tools, both manual and powered, that are used to set pull-type blind fasteners. For industrial production, it is desirable to use a power tool that may have an air, hydraulic or electrical power assist to pull the mandrel stem. This facilitates the rivet setting operation. Such tools are normally manually loaded, that is, the mandrel stem is manually inserted in to the nose portion of the rivet setting tools. This requires the tool operator to hold the tool with one hand and select the individual blind rivets, from a bulk source, for example, with the other hand and insert the mandrel stem into the nose of the setting tool. This presents a slow and cumbersome rivet handling problem during the rivet setting operation. The invention provides a highly reliable approach to automating this operation.

Thus, for example, in the use of blind rivet fasteners, it is desirable to provide a device for automatically presenting the mandrel stem in a position for insertion in the nose of the rivet setting tool which eliminates the necessity of the operator manually inserting the mandrel stem into the setting tool during each rivet setting operation. Various approaches to this requirement are illustrated in commonly assigned U.S. Pat. Nos. 3,415,102; 4,205,547; and 4,592,136. The automatic rivet feed device of U.S. Pat. No. 4,205,547 is attached to the nosepiece of the rivet installation tool, and includes a chuck for holding the rivet and a parallel crank and slider mechanism for moving the chuck into alignment with the receiving mechanism of the tool.

Devices for feeding different types of fasteners are also shown in U.S. Pat. Nos. 2,832,458; 3,276,625; 3,494,014; 3,535,764 and 3,658,207.

Accordingly, it is an object of the invention to provide a rivet loading device of simple construction which is capable of reliably, rapidly receiving a rivet from a supply and inserting the rivet into the nosepiece of an installation tool. Another object is to provide a versatile rivet presentation scheme which may be adapted both to lightweight hand-held installation tools and sturdier, automated installation machines. Desirably, such device should be capable of efficiently rejecting unsuccessfully inserted rivets.

SUMMARY OF THE INVENTION

In further in the above and additional objects, the invention provides a device for automatically positioning a fastener in a predetermined, desired orientation and location, and for inserting the fastener in an application tool, incorporating a transfer member having a chamber accessible via an exterior opening, said chamber being configured to loosely house a portion of the fastener. Means are provided for inducing a negative pressure in the chamber to attract and hold the fastener therein, and for reversing the negative pressure to a positive pressure on command to expel the fastener. The device also includes means for reversibly transporting the transfer member between an out-of-the-way "retracted position" and an "advanced position" aligned with a receiving mechanism in the application tool. In the operation of said device, fasteners are successively delivered from a bulk supply to the opening of the transfer member while said transfer member is in its retracted position and under negative pressure, thereby causing the delivered fastener to be drawn into and held by the transfer member, to be subsequently transported to the advanced position where the fastener is expelled into the application tool.

The preferred embodiment of the invention relies upon a rapid reversal from a negative to a positive pressure within the transfer member's chamber to propel the fastener into the applicator tool. In an alternative embodiment, the fastener is brought adjacent to a receiving mechanism in the application tool, and the negative pressure is relieved to release the fasteners and permit capture by the receiving mechanism. The released fastener may be drawn into the receiving mechanism by a negative pressure, or may be inserted therein by the motion of the transfer member.

In accordance with one aspect of the invention, the application tool has an insertion axis which intersects the receiving mechanism and advanced position, and the transporting means has a motion axis which is not coincident with the insertion axis. In one embodiment, the transporting means successively axially and angularly transports the transfer member with reference to the motion axis, between the advanced and retracted positions. In a particular version, the transporting means comprises a reciprocably mounted transfer slide and a rotary actuator secured to said transfer slide, the transfer member being rotatably mounted to said rotary actuator, said transfer slide being reciprocably driven, and the rotary actuator including means for rotating the transfer member. The invention also encompasses alternative mechanisms within the transfer member for releasably engaging the fastener, wherein the transporting means is as described in the immediately preceding sentence.

In alternative embodiment of the invention, the transfer member is simultaneously transported axially and angularly (relative to the motion axis) between its retracted and its advanced positions. In a particular version, the transporting means includes a guide member having a sliding axis essentially parallel to the insertion axis, and a slide member mounted to the guide member to permit axial and angular motion with reference to the sliding axis. Either the guide member or slide member has a cam track which extends both axially and angularly, and the other has a cam follower fixed thereto and slidably mounted within the cam track. The transfer member is secured to the slide member, and means are provided for reciprocating the slide member, thereby to cause axial and angular motion of the transfer member. The invention also encompasses alternative means within the transfer member for reversibly engaging the fastener in a predetermined orientation, wherein the transporting means is as described in this paragraph.

In one embodiment of the invention, the application tool and the device for positioning and inserting fasteners in such tool are both mounted to a superstructure of a fastener installation machine. In another embodiment, wherein the application tool is portable and manually operated, such device is fixed to the tool or integral therewith so that the retracted and advanced positions of the transfer member bear a fixed spatial relationship to the tool. The device of the invention is advantageously adapted to the automated and semi-automated installation of fasteners, and for this purpose the device may incorporate sensors for directly or indirectly detecting the position of the transfer member.

BRIEF DESCRIPTION OF THE DRAWINGS

The above and additional aspects of the invention are illustrated with reference to a preferred embodiments of the invention in the following detailed description thereof, to be read in conjunction with the drawings in which:

FIG. 1 is a perspective view of an automatically operated rivet installation tool being fed a rivet by a preferred design of rivet presentation assembly, in its advanced position, with the transfer head shown in section to reveal its internal structure;

FIG. 2 shows the apparatus of FIG. 1 with the tool in its installation position, and the presentation assembly in its retracted position;

FIG. 3 is a side sectional view of the junction between the rivet transport hose and the transfer head, taken along the lines 3—3 in FIG. 6;

DETAILED DESCRIPTION

Figure 6:
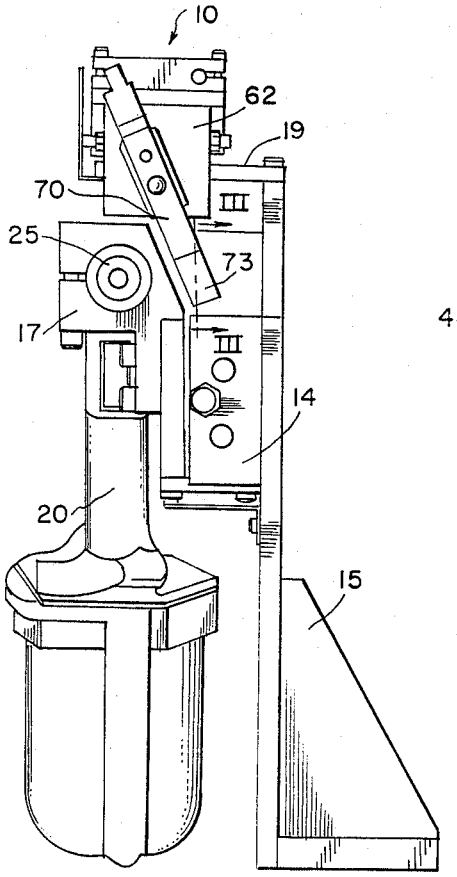
FIG. 6 is a front elevation view of the apparatus of FIG. 1.

Reference should now be had to FIGS. 1-6 for a detailed description of a fastener presentation device in accordance with a first, preferred embodiment of the invention. The rivet presentation apparatus 10 is designed to receive rivets 12 which are successively fed from a bulk supply (as by rivet transport hose 28), place each such rivet in a desired position and orientation relative to rivet installation tool 20, and insert the rivet into the nosepiece 25 of the tool for installation. As best seen in FIG. 6, the rivet presentation device 10 is mounted to the superstructure 15 of an automatic rivet installation machine, which superstructure includes a clamp 17 for holding the rivet installation tool 20, brackets 13 and 14 (FIG. 1) which support mechanisms for longitudinally displacing the tool 20; and a support bracket 19 for the moveable elements of the rivet presentation assembly 10. This assembly includes a transfer arm 70 having a transfer head 73 which releasably engages a rivet 12, and which is moveable between a retracted position wherein transfer head 73 may receive a rivet delivered by the transport tube 28 (cf. FIGS. 2, 3) and an advanced position in which the transfer head 73 is aligned with the tool nosepiece 25 in order to insert fastener 12 into such nosepiece (FIG. 1). Apparatus 10 further includes mechanisms for transporting the transfer head 73 between its retracted and advanced positions: a transfer slide assembly 40 which reciprocates the transfer arm 70 along an axis essentially parallel to the tool insertion axis of installation tool 20, and a rotary assembly 60 which moves transfer head 73 angularly relative to the sliding axis to align the rivet with the nosepiece. In the embodiment of FIGS. 1-6, these axial and angular motions are effected sequentially.

With further reference to FIGS. 1 and 2, the transfer slide assembly 40 includes a slide panel 45 to which is secured blocks 43 and 44, and the rotary assembly 60 including transfer arm 70 is fixed to slide panel 45 at one end thereof. A pair of piston rods 42 (only one of which is seen in the drawings) are secured at each end to blocks 43 and 44, and are slidingly mounted within air cylinder assembly 48 to be reciprocated between the end positions shown in FIGS. 1 and 2. Therefore, upon pressurization from air supply 46, the rods 42, blocks 43 and 44, slide panel 45, and rotary actuator 62 will all move to the advanced position (FIG. 1); upon pressurization of the supply line 47, the reverse motion will occur. Location of the slide assembly at its retracted position will be indicated by the position sensor 55, which in this position of the transfer slide 45 will sense the metallic metal finger 51 attached to pneumatic actuator assembly 48. When slide panel 45 is its advanced position, this will be indicated by a positive signal from the position sensor 53.

The rotary assembly 60 includes a rotary actuator 62, to which transfer arm 70 is pivotally mounted. Upon pressurization via air line 65, a pneumatic actuator within assembly 62 rotates a shaft (not shown) on which the transfer arm 70 is mounted. This swings the transfer arm from its retracted position (FIG. 2) to its advanced position (FIG. 1). The positioning of the transfer arm 70 at its retracted position is sensed by the position sensor 68, which detects the metal finger 71; similarly, position sensor 66 will indicate when the presence of transfer arm 70 is in its advanced position. The position feedback from sensors 53, 55, 66 and 68 may be fed to a control program for the rivet presentation assembly 10, which control program could be used for example to selectively actuate a plurality of solenoid valves to selectively pressurize the air lines 46, 47, and 65. Electronic control apparatus may ensure that these motions occur in an orderly manner (rotary motion initiated only after completion of sliding motion is sensed, for example), and may key other system functions to the sensor outputs. Control apparatus of this type is the subject of a commonly assigned U.S. patent application of A. Weeks et al. entitled "Automated Blind Rivet Installation", U.S. Ser. No. 027,763 filed Mar. 19, 1987.

Figure 4:
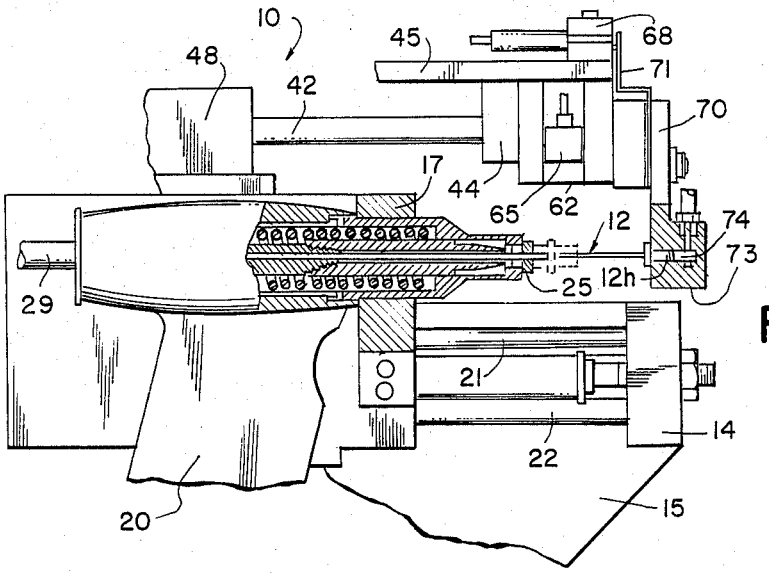
FIG. 4 is a partially sectioned side view of the installation tool and the rotatable rivet arm, corresponding to the phantom position of the rivet arm in FIG. 1.

In the preferred design of transfer head 73, as shown in FIGS. 3, 4, this assembly attracts and holds a blind rivet 12, and later expels this rivet, pneumatically. Transfer head 73 includes a chamber 74 in which positive and negative pressure states may be induced via air line 76. The chamber 74 terminates at its rivet-engaging end at an aperture 77, at which the chamber 74 has chamfered surface 75. The rivet engaging portion of the chamber 74 has an essentially circular profile of a diameter slightly larger than the outer diameter of the cylindrical body **12*h* of rivet 12. This configuration enables the chamber 74, when under vacuum, to reliably capture and loosely engage the fastener 12 in a predetermined orientation, so that upon reversal of the pressure within chamber 74 to a positive pressure, the fastener 12 will be expelled from the chamber. Advantageously, the pressure reversal from negative to positive occurs relatively rapidly, to ensure that rivet 12** will be propelled along the insertion axis.

With reference to FIG. 3, a given rivet is delivered from a bulk supply (not shown) via transport hose 28 to bushing 81 supported by frame 15. One possible system for receiving a bulk supply of rivets and sequentially transporting rivets therefrom to the hose 28 is disclosed in commonly assigned U.S. Pat. No. 3,580,457. Bushing 81 defines a convergent duct 82, through which the rivet 12 is guided, with head **12*h* leading, to the chamber 74 of transfer head 73. After transfer to the advanced position, the mandrel stem 12*m* is aligned with the insertion axis of the tool 20 and proximate to the nosepiece 25 (FIG. 4). Upon recognition by the position sensor 66 that the transfer arm 70 has reached its advanced position, a positive pressure will be induced within chamber 74 and fastener 12 will be propelled into the nosepiece 25**.

In an alternative embodiment, the rivet 12 is positioned by the presentation device closely adjacent the nosepiece 25, and rather than a rapid negative-to-positive pressure reversal the vacuum is simply relieved to release the fastener and permit its capture by a receiving mechanism within the nosepiece. The released fastener may be drawn into the receiving mechanism by a negative pressure, or may be inserted therein by the motion of transfer head 73.

Figure 5:
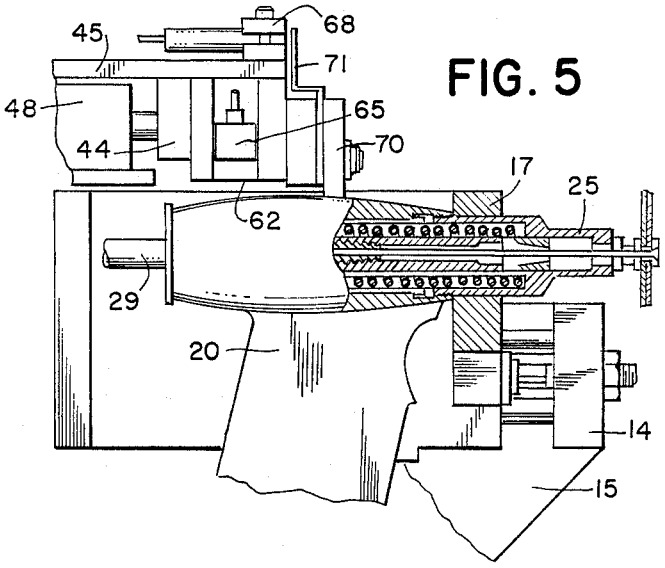
FIG. 5 is a further partially sectioned view of the installation, tool, shown setting a rivet into a workpiece.
Figure 7:
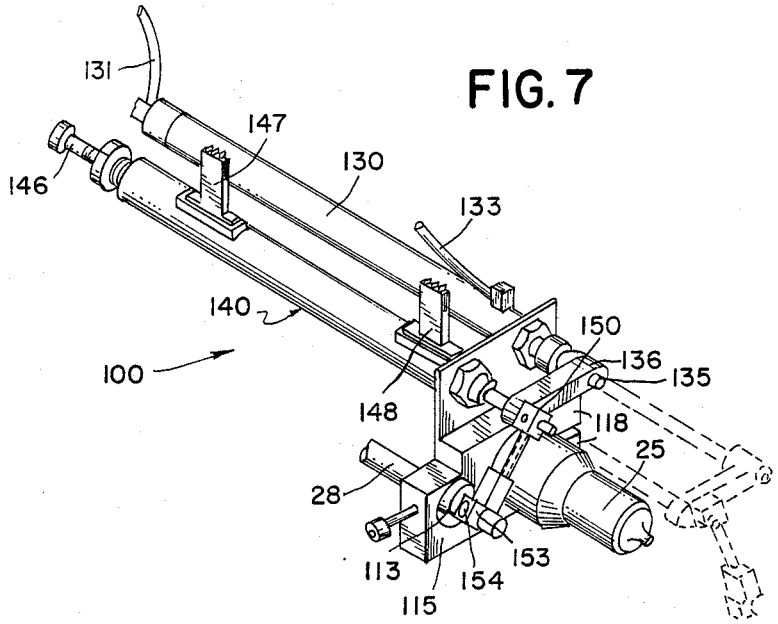
FIG. 7 is a perspective view of an alternative rivet presentation assembly, to be attached to a handheld rivet installation tool.

Upon recognition of a successful insertion of rivet 12 into nosepiece 25, the tool 20 is advanced by pneumatic slide 23, on guide rods 21, 22, to an advanced position for installation of a rivet. Reference may be had to commonly assigned U.S. Pat. No. 3,254,522 for a disclosure of a fluidically-actuated rivet installation tool having suitable setting and installation mechanisms (partially shown in FIGS. 4 and 5 herein). FIG. 5 illustrates the operation of setting a rivet into workpiece 100, and of eliminating a spent mandrel **12*m* from tool 20 via mandrel collection hose 29**.

In the event rivet 12 is not successfully inserted into the tool 20, however, the pressure state within transfer head 73 can revert to a vacuum, to draw back the rivet 12 (presumably faulty). Thereupon transfer arm 70 may transport this rivet to an out-of-the-way position and discard it with a blast of air.

FIGS. 7–10 illustrate an alternative rivet presentation assembly 100 which may be mounted to a lightweight portable installation tool the nosepiece of which is shown at 25. A support bracket 115 carries the various structures of assembly 100, and such bracket includes a clamp 118 for the nosepiece 25. Pneumatic actuator cylinder 130, when pressurized via supply line 131, extends the piston rod 135 and link 136 as shown in the phantom position of FIG. 7. Pressurization via line 133 causes the retraction of these structures. Guide cylinder 140 houses rod 141, which is rotationally and reciprocably mounted therein. Rod 141 is journaled within link 136 (FIG. 9) so that the extension or retraction of link 136 causes a like extension or retraction of rod 141, but permits a relative rotation of this rod. Transfer arm 150, which includes transfer head 153 for releasably engaging a rivet, is secured to rod 141 to rotate and reciprocate in conjunction therewith.

Figure 8:
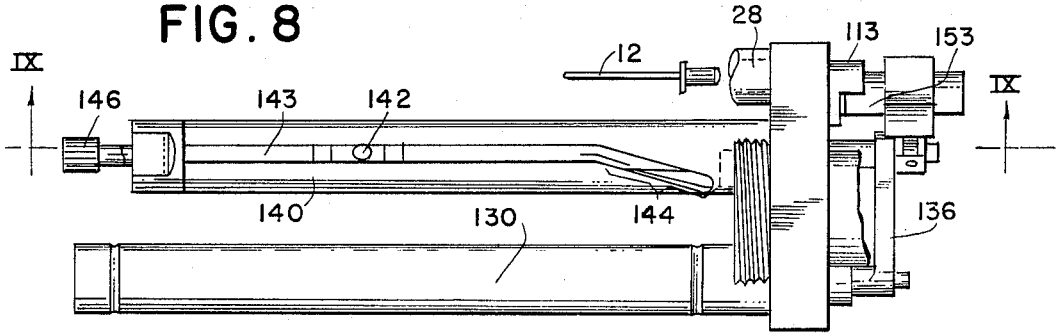
FIG. 8 is a bottom perspective view of the rivet presentation assembly of FIG. 7.
Figure 9:
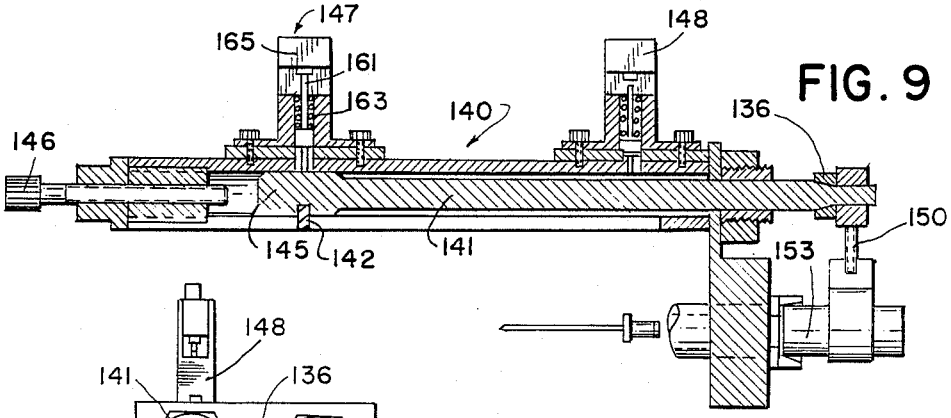
FIG. 9 is side sectional view taken along the central axis of the guide cylinder, at 9—9 in FIG. 8.

As shown in FIG. 8, a cam track 143 is cut in the surface of the guide cylinder 140 to extend generally axially along most of the length of such cylinder; a portion 144 of cam track 143 also extends circumferentially (i.e. angularly). A cam follower appendage 142 of the rod 141 is mounted in cam track 143, so that the rotational positioning of the rod is defined by the position of the cam follower 142 within cam track 143. Therefore, upon extension of piston rod 135 and link 136, the rod 141 will be similarly extended without rotating during much of its travel. Toward the end of its travel towards its advanced position, the rod 141 will be rotated thereby causing the rotation of transfer arm 150 as shown in the phantom view of FIG. 6.

The location of rod 141 at its retracted and advanced positions is respectively detected by position sensors 147, 148. Sensor assembly 147, as seen in section in FIG. 9, includes a pin 161 which is downwardly biased by a compression spring 163, and a limit switch 165. When rod 141 is in its retracted position, the thicker end portion 145 of the rod forces up pin 161 to actuate limit switch 165.

The guide cylinder 140 also includes an adjustment screw 146 which defines a variable end point to the travel of rod 141.

Figure 10:
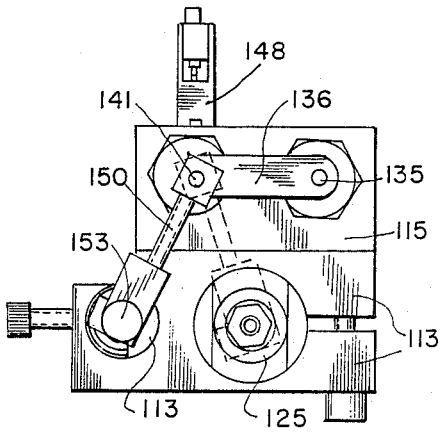
FIG. 10 is an end elevation view of the rivet presentation assembly of FIG. 7.

Reference should be had in particular to FIG. 10 to illustrate the operation of rivet presentation assembly 100. In order to receive a new rivet, the transfer head 153 is aligned proximate the bushing 113, which receives rivets successively transported from a bulk supply via hose 28 (FIG. 8) for delivery to and engagement by the transfer head 153. Transfer head 153 may engage rivets pneumatically, as discussed above with reference to the embodiment of FIGS. 1–6, or with a mechanical chuck arrangement as well known in the prior art. Upon engagement of the rivet, the transfer arm 150 is extended and rotated to its advanced position (shown in phantom in FIG. 10), where it is aligned with nosepiece 25 for insertion of the rivet.

In a variation of the apparatus of FIGS. 7–10, not shown in the drawings, the air cylinder serves as a guide member for a sleeve which is slidably and rotatably mounted thereto. The cam track is cut in the sleeve, and the cam follower is fixed to one end of the air cylinder to cause the rotational motion of the sleeve as it slides relative to the air cylinder. This design is more compact than that of FIGS. 7–10.

While reference has been made above to specific embodiments, it will be apparent to those skilled in the art that various modifications and alterations may be made thereto without departing from the spirit of the present invention. For example, although the presentation assemblies of FIGS. 1–10 are shown handling a mandrel rivet, they may be easily adapted to the positioning and insertion of other fasteners by suitably configuring the chamber in the transfer member in accordance with the fastener shape. Although the illustrated embodiments show a single fastener being presented to a single application tool, the transfer arm may include multiple chambers each for engaging a fastener to be presented to a respective application tool. As a further variation, the presentation assembly may be integral with the application tool, rather than a discrete assembly for use alongside or mounted to the tool.

We claim:

1. A device for automatically positioning a fastener in a predetermined, desired orientation and location, and inserting the fastener into a tool having a mechanism for engaging the fastener and installing it in a workpiece, comprising:

a transfer member having a chamber accessible via and exterior opening, said chamber being configured to loosely house a portion of the fastener;

means for inducing a negative pressure in the chamber to attract and hold the fastener therein, and for reversing the negative pressure to a positive pressure to expel the fastener;

means for transporting the transfer member between a "retracted position" removed from the workpiece and an "advanced position" aligned with the mechanism in the tool, wherein fasteners are successively delivered from a supply to the opening of the transfer member while said transfer member is in its retracted position and under negative pressure, thereby causing the delivered fastener to be drawn into the chamber and held by the transfer member, to be subsequently transported to the advanced position where the fastener is expelled by the positive pressure to the tool mechanism.

2. A device as defined in claim 1 wherein the transporting means comprises a reciprocably mounted transfer slide and a rotary actuator secured to said transfer slide, said transfer member being rotatably mounted to said rotary actuator, said transfer slide being reciprocably driven, and said rotary actuator including means for rotating the transfer member.

3. A device as defined in claim 1 herein the transporting means is fluidically actuated.

4. A device as defined in claim 1, wherein the device is mounted to a superstructure of a fastener installation machine, for automated operation.

5. A device as defined in claim 1, for use with a portable fastener installation tool, wherein said device is mounted to said tool, so that the retracted and advanced positions of the transfer member bear a fixed spatial relationship to the tool.

6. A device as defined in claim 1 further comprising position sensor means mounted to said device for directly or indirectly detecting the presence of the transfer member at the advanced and reacted positions.

7. A device as defined in claim 1 wherein the inducing means causes a rapid reversal from the negative pressure to the positive pressure.

8. A device as claimed in claim 1 wherein the fastener has a head portion and a stem portion, and wherein the chamber houses the head portion of the fastener.

9. A device as claimed in claim 1 wherein the device maintains the fastener while at the advanced position with the stem portion aligned with the tool mechanism, and expels the fastener along the axis defined by its stem portion.

10. A device as claimed in claim 9 wherein the transporting means maintains the axial orientation of the fastener during the passage between the reacted and advanced positions.

11. A device as defined in claim 9 wherein the transfer member is simultaneously transported axially and angularly with reference to said axis.

12. A device as defined in claim 11 wherein the transporting means comprises a guide member whose axis is essentially parallel to the insertion axis; a slide member mounted to said guide member so as to permit relative axial and angular motion with reference to the guide member axis, the transfer member being secured to said slide member; and means for reciprocating the slide member relative to the guide member, wherein one of the guide member and slide member includes a cam track extending both axially and angularly, and the other carries a fixedly mounted cam follower which is slidably mounted within the cam track, so that reciprocation of the slide member causes axial and angular motion of the transfer member according the cam track profile.

13. A device as defined in claim 12 wherein the guide member comprises a cylinder with said cam track, and the slide member comprises a rod journaled within said guide cylinder.

14. A device for automatically positioning a fastener in a predetermined, desired orientation and location, and inserting the fastener into a tool having a mechanism for engaging the fastener and installing it in a workpiece, comprising:

a transfer member having a chamber accessible via an exterior opening, said chamber being configured to loosely house a portion of the fastener;

means for inducing a negative pressure in the chamber to attract and hold the fastener therein, and for reversing the negative pressure to a positive pressure to expel the fastener;

means for transporting the transfer member between a "retracted position" removed from the workpiece and an "advanced position" aligned with the mechanism in the tool, wherein fasteners are successively delivered from a supply to the opening of the transfer member while said transfer member is in its retracted position and under negative pressure, thereby causing the delivered fastener to be drawn into the chamber and held by the transfer member, to be subsequently transported to the advanced position where the fastener is expelled by the positive pressure to the tool mechanism.

15. A device as defined in claim 14, wherein the released fastener is drawn to the mechanism by a negative pressure from the tool.

16. A device as defined in claim 14, wherein the released fastener is inserted into the mechanism by the movement of said transfer member.

17. For use with a rivet installation tool having a rivet engaging mechanism, wherein said tool installs rivets in workpieces along an insertion axis, a device for positioning and orienting a rivet adjacent the mechanism and transferring the rivet thereto, comprising:

a transfer member including means for releasably engaging the rivet in an orientation essentially parallel to the insertion axis;

a guide member having a sliding axis essentially parallel to the insertion axis;

a slide member mounted to said guide member so as to permit axial and angularly motion with reference to the sliding axis, wherein one of the guide member and slide member includes a cam track extending both axially and angularly, and the other has cam follower secured thereto and slidably mounted within the cam track, said transfer member being mounted to said slide member so that motion of the latter along the sliding axis does not alter the orientation of said rivet; and means for reciprocating the slide member relative to the guide member, wherein fasteners are successively delivered from a supply to the releasably engaging means while said transfer member is in a retracted position removed from the workpiece, whereupon the transfer member engages the fastener, and the slide member slides relative to the guide member to move the fastener to an advanced position for insertion into the tool.

18. A device as defined in claim 17, wherein the guide member comprises a cylinder having the cam track, which extends both axially and circumferentially along the guide cylinder surface, and wherein the slide member comprises a rod journaled within said cylinder.

19. A device as defined in claim 17, wherein the application tool and said device are mounted to a superstructure of a rivet installation machine, for automated operation.

20. A device as defined in claim 17 wherein the rivet installation tool is portable, and said device is mounted to said tool, so that the retracted and advanced positions of the transfer member bear a fixed spatial relationship to the tool.

21. A device as defined in claim 17, further comprising position sensor means mounted to said device for directly or indirectly detecting the placement of the transfer member at the advanced and retracted positions.

* * * * *